United States Patent [19]

Ullman

[11] 4,021,513

[45] May 3, 1977

[54] CARBURETERS

[75] Inventor: Thomas James Ullman, Cranfield, England

[73] Assignee: The Zenith Carburetor Company Limited, Stanmore, England

[22] Filed: Nov. 4, 1974

[21] Appl. No.: 520,656

[30] Foreign Application Priority Data

Nov. 7, 1973 United Kingdom ..... 51756/73

[52] U.S. Cl. ..... 261/50 A; 261/DIG. 56; 261/121 B; 261/DIG. 39

[51] Int. Cl.[2] ..... F02M 9/08

[58] Field of Search ..... 261/50 A, 121 B, DIG. 56, 261/DIG. 58, DIG. 60, 62, DIG. 39

[56] References Cited

UNITED STATES PATENTS

| | | | |
|---|---|---|---|
| 1,172,388 | 2/1916 | Prescott | 261/DIG. 60 |
| 1,225,466 | 5/1917 | Merriam | 261/41 A |
| 1,527,913 | 2/1925 | Payne | 261/DIG. 39 |
| 1,547,296 | 7/1925 | Bullard | 261/62 |
| 2,038,785 | 4/1936 | Gould | 261/50 A |
| 2,052,225 | 8/1936 | Hartshorn | 261/DIG. 56 |
| 2,709,579 | 5/1955 | Sykes | 261/DIG. 56 |
| 3,069,146 | 12/1962 | MacNeill | 261/62 |
| 3,334,876 | 8/1967 | Shorrock | 261/62 |
| 3,342,464 | 9/1967 | Mick | 261/44 R |
| 3,618,578 | 11/1971 | Swatman | 261/44 R |
| 3,752,451 | 8/1973 | Kendig | 261/50 A |
| 3,779,530 | 12/1973 | Lawrence | 261/44 R |

FOREIGN PATENTS OR APPLICATIONS

| | | | |
|---|---|---|---|
| 141,003 | 9/1920 | United Kingdom | 261/121 B |

*Primary Examiner*—Tim R. Miles
*Attorney, Agent, or Firm*—Stevens, Davis, Miller & Mosher

[57] ABSTRACT

A twin air valve carbureter has a single bar which extends diametrically across the two draught tubes upstream thereof, and two air valve flaps which are mounted on opposite sides of the bar, so as to extend across both draught tubes, and are hinged at their ends remote from the bar. Both the flaps co-operate with the bar to define a throat of variable area. The fuel discharge ports are formed in the bar and comprise outwardly-divergent slot ports. A depression responsive fluid pressure motor is linked to each of the flaps to provide compensation for the effect of the reduction of the effective area of each flap as that flap opens. A novel linkage is disclosed for linking a fuel metering needle to one of the flaps.

24 Claims, 6 Drawing Figures

CARBURETERS

This invention relates to air valve carburetters of the pivoted flap air valve type.

An air valve carburetter of the pivoted flap air valve type comprises a body which defines one or more through passages. The or each through passage has an air valve flap mounted pivotally therein. The or each pivoted flap co-operates with adjacent structure to define a throat of variable area within the respective through passage and is arranged to move about its pivot mounting to vary the area of the respective variable area throat in response to a tendency for a depression established within the respective through passage between the respective pivoted flap and a throttle valve downstream thereof to vary. An air valve carburetter of the pivoted flap air valve type also includes a fuel supply system operable to supply metered quantities of fuel from a respective fuel metering orifice to that part of the respective through passage between the respective pivoted flap and the throttle valve downstream thereof through a fuel discharge nozzle. The area of the or each fuel metering orifice may be varied in accordance with variations in the area of the respective variable area throat or throats by movement of a respective profiled needle which projects through the fuel metering orifice and which is coupled to the respective pivoted air valve flap or flaps for movement therewith.

An object of this invention is to provide an air valve carburetter of the pivoted flap air valve type which operates to distribute fuel supplied to that part of the respective through passage between the respective pivoted flap of the throttle valve downstream thereof widely through that part of the passage.

If the or each pivoted air valve flap co-operates with an adjacent portion of the wall of the respective through passage to define the respective variable area throat and the fuel discharge nozzle through which metered quantities of fuel are supplied to the respective through passage is in the wall of the respective through passage, there is a tendency for the fuel supplied to the respective through passage to be concentrated in that part of the through passage adjacent the wall within which the fuel discharge nozzle is located. Another object of this invention is to reduce the tendency for fuel discharged into a through passage to be concentrated in that part of the through passage adjacent to a wall thereof.

It can be shown that a relatively high fuel flow loss occurs if metered quantities of fuel are supplied to a carburetter throat through a fuel discharge nozzle which comprises a parallel sided slot that is orientated with respect to the throat so that fuel discharged therethrough is directed in a direction normal to the path of air flow through the throat. Thus, although the general fuel presentation characteristics may be favourable, the fuel consistency at low rates of fuel supply is relatively poor. The fuel flow energy losses can be reduced if the fuel discharge nozzle is directed downstream with respect to the air flow through the throat. However, fuel tends to be supplied to the respective through passage in concentration of unatomized liquid fuel and tends not to be introduced directly into the main air stream, if it is supplied through a downstream directed nozzle. Moreover, the fuel presentation is less favourable than if the slots direct the fuel into the throat in a direction normal to the path of air flow.

Another object of the invention is to provide a fuel discharge nozzle for a carburetter which results in better fuel consistency at low fuel flow rates than is supplied through a parallel sided fuel discharge nozzle of the slot type, whilst retaining the good fuel presentation characteristics and the favourable fuel supply performance at high flow rates associated with such parallel sided fuel discharge nozzles of the slot type.

The effective area of the or each pivoted air valve flap, which is the area upon which a depression established within the respective through passage between the respective pivoted flap and a throttle valve downstream thereof acts to urge the flap to open further, diminishes as the flap opens. Another object of this invention is to compensate for the reduction of the effective area of the or each pivoted air valve flap as that pivoted flap opens in such a way that the position adopted by the or each pivoted air valve flap within the respective through passage, and thus the velocity of air flow through a throat defined between the respective pivoted air valve flap and adjacent structure, is more directly related, throughout the range of pivotal movement of the respective flap, to a depression established within the respective through passage between the respective pivoted flap and a throttle valve downstream thereof than would be so if the position adopted by the or each pivoted air valve flap was determined solely by the action of the depression upon the flap.

Another object of this invention is to minimise the influence of vibration upon a linkage by which the or each pivoted air valve flap is linked to a respective profiled needle in a carburetter of the pivoted flap air valve type in which the effective area of the or each fuel metering orifice is varied by movement of a respective profiled needle.

A twin choke air valve carburetter of the pivoted flap type which embodies the present invention includes a bar which is supported by the body and which extends diametrically with respect to the two through passages between a pair of air valve flaps which are mounted pivotally within the body. Each of the air valve flaps co-operates with the bar to define the respective variable area throat. At least one fuel discharge nozzle is formed on each side of the bar for supplying metered quantities of a fuel/air mixture to the respective variable area throat. That part of the surface of each pivoted air valve flap which co-operates with the bar to define a variable area throat is curved convexly so that, at least during initial opening movement and final closing movement of the air valve flap, the part of the bar which is nearest to the air valve flap at any one time is substantially as close as is possible to that part of the bar which co-operates with the air valve flap when the air valve is closed.

In a preferred embodiment of this invention the arrangement is such that, during movement of each air valve flap, the locus of that part of the pivoted flap which is nearest the bar is substantially in a plane which is normal to that part of the bar which is engaged by the flap when that flap is closed. Each pivoted flap is hinged to the body at a point opposite the bar so that that part of the flap nearest the bar structure is drawn towards the throttle valve by engine suction, the profiled surface of each flap being the upstream surface thereof.

Preferably, the upstream edge of each of the fuel discharge nozzles lies in or adjacent to said plane. Air supply means may be provided for feeding air to the or each fuel metering orifice for mixture with fuel therein to form an air/fuel emulsion in a manner similar to that described in U.S. Pat. No. 3,684,257. The air supply means may include a restriction and may be arranged to draw air from the induction passage upstream of the pivoted air valve flap. Conveniently the mouth of the air supply means is defined in the wall of the induction passage which is opposite the bar and within which the respective pivoted air valve flap is hinged, the arrangement being such that the pressure at the mouth of the air supply means is lower when the respective air valve flap is in its open position than it is when that air valve flap is in its closed position so that the air flow to the fuel metering orifice is less when that flap is in its open position than it is when that flap is in its closed position.

Preferably each fuel discharge nozzle comprises a divergent slot port, the inlet of the port having a smaller cross-sectional area than the outlet thereof. The carburetter includes a depression responsive fluid pressure motor which is linked to each of the two air valve flaps.

One embodiment of this invention will be described now by way of example with reference to the accompanying drawings, of which:

Figure 1:
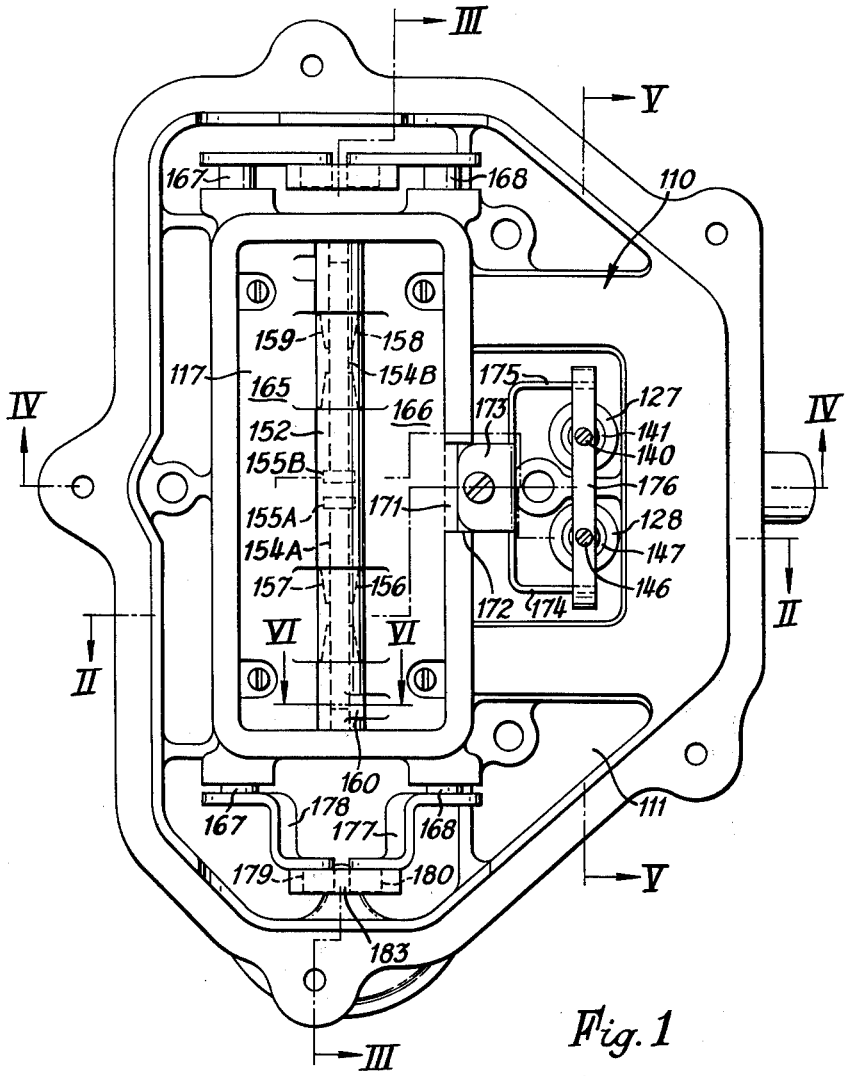
FIG. 1 is a plan view of a twin choke downdraught carburetter of the pivoted flap air valve type.

Referring to the drawings, the carburetter comprises a body 110 consisting of an upper casting 111, a lower casting 112 and a middle casting 113. The three castings 111, 112 and 113 are bolted together with a gasket 114 clamped between the upper and middle castings 111 and 113 and with a gasket 115 clamped between the middle and lower castings 112 and 113. The castings 111, 112 and 113 together define a float chamber 116 and a branched through passage which serves as the induction passage of the carburetter. The middle casting 113 defines the junction by which a single rectangular through passage 117 in the upper casting 111 communicates with two parallel circular through passages 118 and 119 in the lower casting 112. The lower casting 112 has a lateral flange 120 by which the body 110 is arranged to be bolted in position on an automobile engine so that the passage 117, 118 and 119 extend substantially vertically.

The float chamber 116 contains a pair of the usual floats 121 and 122 and a fuel supply control valve 123 which controls the supply of fuel from a fuel tank of the automobile to the float chamber 116, the floats 121 and 122 and the fuel supply control valve 123 cooperating in a conventional manner to maintain the level of fuel within the float chamber 116 substantially constant. The floats 121 and 122 and the fuel supply control valve 123 are set so that the volume of fuel maintained within the float chamber 116 is less than half the total volume of the float chamber 116. A hole 124 (FIG. 4) in the middle casting 113 is above the level of fuel maintained in the float chamber 116 and serves as a vent orifice for the float chamber 116. The middle casting 113 is arranged so that the inner end of the hole 124 is so located within the float chamber 116 that it is always above the level of fuel normally maintained in the float chamber by the control valve 123 whatever the attitude of the carburetter.

Figure 5:
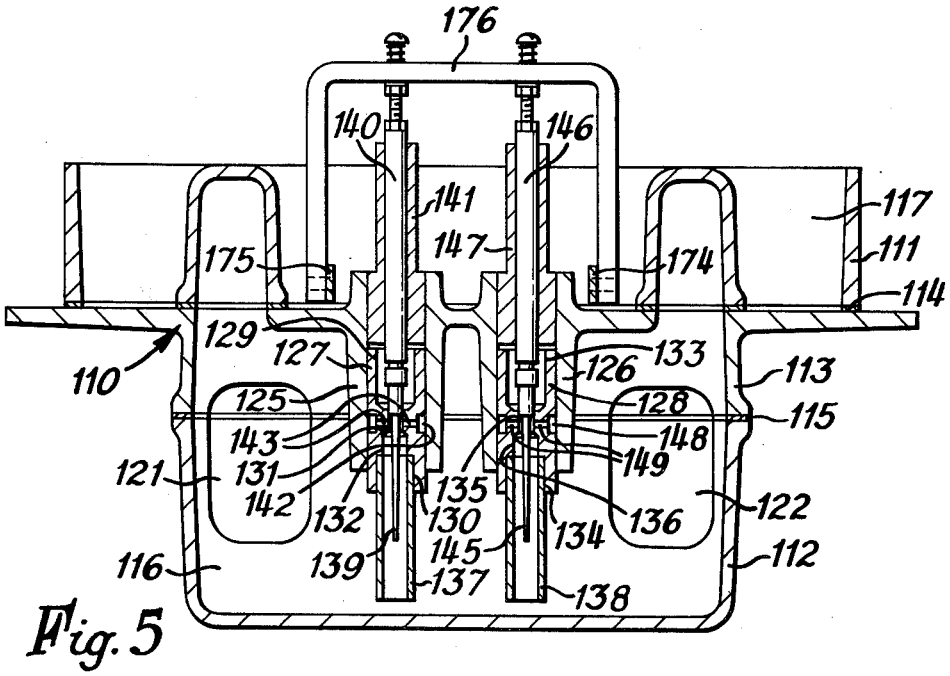
FIG. 5 is a section on the line V—V of FIG. 1.

The middle casting 113 has two tubular portions 125 and 126 (FIG. 5) formed integrally therewith. Each tubular portion 125, 126 extends upwardly through the gasket 114, downwardly into the float chamber 116 to a point below the level of fuel normally maintained therein, and has its bore extending substantially parallel to the passages 117, 118 and 119.

Each tubular portion 125, 126 has a respective tubular member 127, 128 spigotted therein in a fluid type manner so that the tubular member 127, 128 projects from the lower end of the tubular portion 125, 126.

The bore of the tubular member 127 is stepped, including two end bore portions 129 and 130 which are spaced apart by two other bore portions 131 and 132 of smaller diameter. The upper, 131, of the two middle bore portions 131 and 132 has the smallest diameter bore and serves as a fuel metering orifice. The tubular member 128 is similar to the tubular member 127 having two end bore portions 133 and 134 which are spaced apart by a fuel metering orifice 135 and an intermediate diameter bore portion 136.

A tube 137 is spigotted into the lower end bore portion 130 of the tubular member 127 so as to abut the shoulder between the bore portions 130 and 132 and so as to project into the float chamber 116. A tube 138 is spigotted into the lower end bore portion 134 of the tubular member 128 so as to abut the shoulder between the bore portions 134 and 136 and so as to project into the float chamber 116.

A profiled needle 139, carried by a cylindrical stem 140, projects through the fuel metering orifice 131, a tubular guide 141 for the stem 140 being spigotted into the upper end of the bore of the tubular portion 125 so as to abut the tubular member 127 and so as to project upwards therefrom. The diameter of the bore of the tubular guide 141 is substantially equal to the diameter of the intermediate diameter bore portion 132. An annular groove 142 in the outer surface of the tubular member 127 surrounds the fuel metering orifice 131 and communicates therewith via radial passages 143. A passage (not shown) extends from the upper end bore portion 129 to the outer surface of the tubular member 127 where it communicates with the end portion (not shown) of a passage 155A in the middle casting 113 (see FIG. 3).

Another profiled needle 145 carried by a cylindrical stem 146 projects through the fuel metering orifice 135, a tubular guide 147 for the stem 146 being spigotted into the upper end of the bore of the tubular portion 126 so as to abut the tubular member 128 and so as to project upwards therefrom. The diameter of the bore of the tubular guide 146 is substantially equal to the diameter of the intermediate diameter bore portion 136. An annular groove 148 in the outer surface of the tubular member 128 surrounds the fuel metering orifice 135 and communicates therewith via radial passages 149. A passage 150 (see FIG. 2) extends from the upper end bore portion 133 to the outer surface of the tubular member 128 where it communicates with the end portion 151 of another passage 155B in the middle casting 113.

The middle casting 113 includes a bar 152 which projects upwardly into the rectangular through passage 117 defined by the upper casting 111 and which extends longitudinally along the centre of that passage 117 from end to end thereof so as to extend diametrically across the two branch passages 118 and 119. The bar 152 is connected to the rest of the middle casting 133 by a web 153 at its centre. The bar 152 defines an aligned pair of longitudinally extending closed ended fuel passages 154A and 154B. Each of the passages 154A and 154B communicates at its end which is adjacent to the other with a respective one of the two passages 154A and 154B in the middle casting 113 so that the fuel passage 154A is in communication with the end bore portion 133 of the tubular member 128 and the fuel passage 154B is in communication with the end bore portion 129 of the tubular member 127.

A diametrically opposed pair of slots 156 and 157 extend laterally from the fuel passage 154A to the outer surface of the bar 152. Another diametrically opposed pair of slots 158 and 159 extend laterally from the passage 154B to the outer surface of the bar 152. The slots 156 to 159 function as fuel discharge nozzles. The pair of slots 156 and 157 are directly above the centre of the branch passage 119 and the pair of slots 158 and 159 are directly above the centre of the branch passage 118. Each slot 156 to 159 diverges laterally, being in communication with the respective fuel passage 154A, 154B via an inlet which has a smaller cross sectional area than the mouth of the respective slot 156 to 159 through which fuel is discharged into the through passage 117. The arrangement of the slots 156, 157, 158 and 159 is best shown in FIGS. 1 and 3.

The bar 152 tapers in an upstream direction from a parallel sided central section of the bar into which the slots 156 to 159 open. The majority of the upstream edge of the bar 152 defines an arcuate edge. Those parts of the bar 152 immediately upstream of each of the slots 156 to 159 are cut away so as to define, in the region of the slots 156 to 159, an edge which is sharper than the edge defined by the remainder of the bar, the sharper edge having a smaller radius of curvature than the arcuate edge defined by the remainder of the bar.

Figures 4, 6:
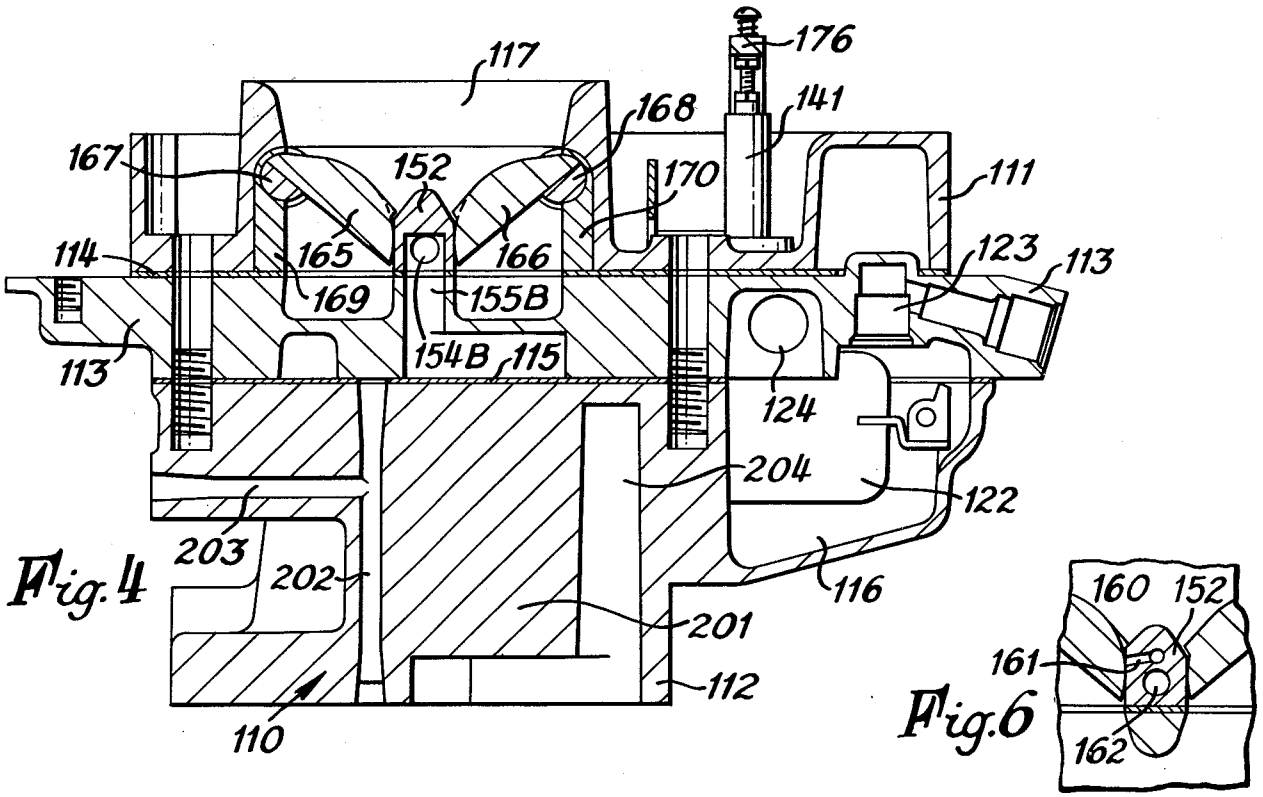
FIG. 4 is a section on the line IV—IV of FIG. 1.
FIG. 6 is a section on the line VI—VI of FIG. 1.

FIG. 6 shows that the side face of the bar 152, into which the slots 156 and 158 opens, is extended in an upstream direction to define a projection 160 between the cut-away portion of the bar upstream of the slot 156 and the end of the bar which is nearer to the slot 156. A passage 161 of restricted dimensions extends from the outer surface of the projection 160 to a closed ended passage 162 which is formed in the bar 152 upstream of the passage 154A with respect to the direction of flow through the through passage 117, and which opens into the end of the bar 152 nearer the slot 156.

Figure 3:
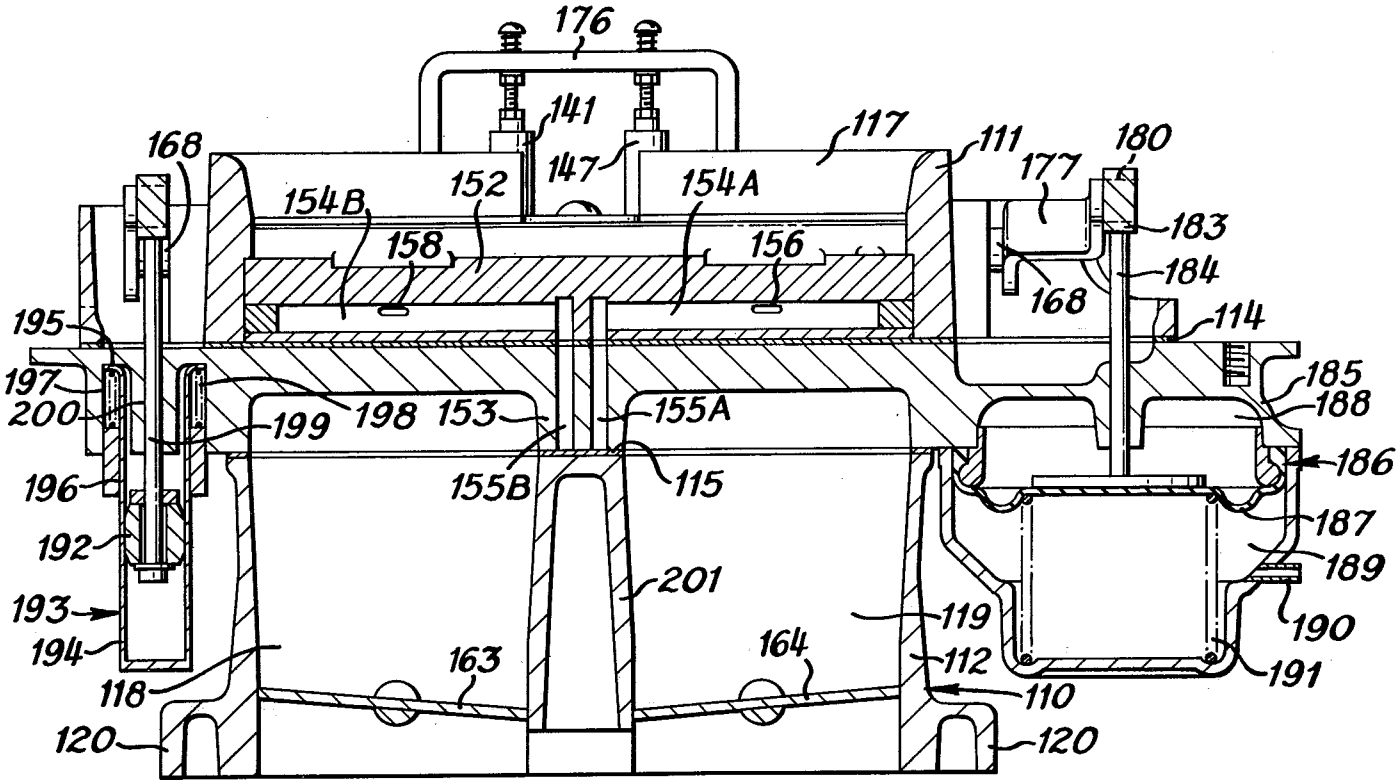
FIG. 3 is a section on the line III—III of FIG. 1.

FIG. 3 shows that the lower casting 112 carries a conventional throttle valve 163, 164 of the butterfly type within each of the branch passages 118 and 119.

Figure 2:
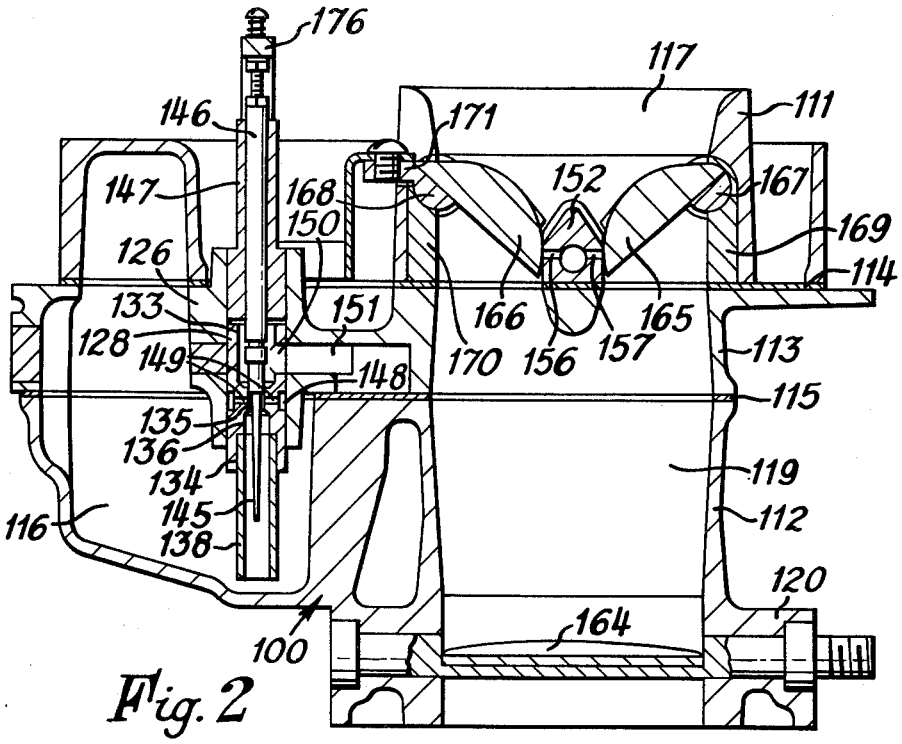
FIG. 2 is a section on the line II—II of FIG. 1.

The bar 152 extends between a pair of air valve flaps 165 and 166 which also extend from end to end through passage 117, each flap 165, 166 extending across the two branch passages 118 and 119. FIGS. 2 and 4 show that each flap 165, 166 has an integral spindle 167, 168 which is received within a corresponding semi-circular recess in a support plate 169, 170. The spindles 167 and 168 are journaled in the end walls of the rectangular through passage 117 defined by the upper casting 111. Each support plate 169, 170 is located within a corresponding recess defined within the respectively longitudinally extending side wall of the rectangular through passage 117, the support plates 169 and 170 being clamped between the upper casting 111 and the gasket 114 by the action of bolting the three castings 111, 112 and 113 together. The spindles 167 and 168 are further from the gasket 114 then are the slots 156 to 159.

The downstream face of each flap 165, 166 is substantially flat and the upstream face is profiled. FIGS. 2 and 4, together with FIG. 1 which includes a plan view of the profiled surface of the flap, show that those parts of the upstream surface of each flap 165, 166 which are aligned laterally with the outlets of the slots 156 to 159 and with the hole 161 are curved convexly so as to define a substantially smooth curve, whereas the intermediate portions include projections which project from the smooth convexly-curved surface to define ridges which are spaced from both ends of the curved surface but which are further from the respective spindle 167, 168 than from the end of the curved surface remote from that spindle 167, 168.

Each air valve flap 165, 166 co-operates with the adjacent face of the bar 152 to define a respective variable area throat. When the air valve is closed, narrow gaps are defined between the smoothly curved portions of the upstream surface of each flap 165, 166, between the end of the flap 165, 166 remote from the respective spindle 167, 168 and the ridges defined on the profiled surface of that flap 165, 166 and the respective side surface of the bar in that region of the upstream edges of the respective fuel discharge slots 156 to 159. The shape of each smooth convexly-curved portion of the profiled surface of each flap 165, 166 is selected so that, during movement of each flap 165, 166 the locus of that part of the smooth convexly curved surface which is nearest to the adjacent side face of the bar 152 and which co-operates therewith to define the throat of variable area remains in the plane which is normal to the parallel side faces of the bar 152 and which passes through the upstream edges of the slots 156 to 159. The ridges defined by the profiled surface of each flap 165, 166 project across any gap which is defined between the respective parts of the respective flap 165, 166 and the bar 152 when the air valve is closed or during the initial stages of opening movement of the air valve flap 165, 166.

FIGS. 1 and 2 show that the flap 166 has an integral tab 171 which projects from the centre of the flap 166, in the region of the spindle 168, through an aperture 172 in the adjacent side wall of the through passage 117. A bifurcated sheet metal link has an angled stem 173 which is fixed at its upper end to the tab 171 on the opposite side from the air valve flap 166 of the adjacent side wall of the rectangular passage 117. The main part of the angled stem 173 extends from the tab 171 towards the gasket 114 and the branches 174 and 175, which are angled also, are generally parallel to the gasket 114. The inner arms of the angled branches 174 and 175 extend from the stem 173 substantially parallel to the adjacent side wall of the through passage 117 and in opposite directions. The outer arms of the branches 174 and 175 extend away from the adjacent side wall of the through passage 117 in a direction substantially normal thereto. The cylindrical guides 141 and 147 for the stems 140 and 146, which carry the profiled needles 139 and 145, extend between the free ends of the branches 174 and 175 with which they are aligned substantially.

A U-shaped link 176 has the free end of each of its arms pinned to the free end of a respective one of the branches 174 and 175. The end of each stem 140, 146 remote from the respective profiled needle 139, 145 projects through a respective aperture in the base of the U-shaped link 176, and through a respective coil spring which constitutes a flexible hinge by which the stem 140, 146 is connected to the U-shaped link 176, each coil spring having one end turn fixed to the respective stem 140, 146 and the other end turn fixed to the base of the U-shaped link 176.

The linkage constituted by the bifurcated sheet metal link and the U-shaped link 176 transmits movement of the air valve flap 165 to the stems 140 and 146 so that the two needles 139 and 145 are moved with movement of the air valve flap 166.

Referring now to FIGS. 1 and 2, the spindles 167 and 168 project through the end wall of the rectangular through passage 117 which is nearer to the branch passage 119 and each carry, on the opposite side of the said end wall from the two air valve flaps 165 and 166, a respective arm 177, 178 for angular movement therewith. Each arm 177, 178 carries a roller 179, 180 at its end remote from the respective spindle 167, 168 (see FIG. 1). Each roller 179, 180 is received within a respective one of two slots which are formed in a head 183 so that they open in opposite directions. The head 183 is fixed to the end of an actuator rod 184 which projects from the hollow casing 185 of an air motor device 186. A rolling diaphragm 187 divides the interior of the motor casing 185 into two chambers 188 and 189 and is connected to the end of the actuator rod 184 remote from the head 183.

The chamber 188, which is defined between the rolling diaphragm 187 and the end wall of the casing 185 through which the actuator rod 184 projects, is maintained at ambient pressure. The chamber 189 is in communication, via a pipe 190 and passages 161, 162 in the bar 152 with one of the branch passages 118 or 119 upstream of the respective throttle valve 163, 164. A coil spring 191 within the chamber 189 reacts against the casing 185 and urges the diaphragm 187 towards the casing end wall through which the actuator rod 184 passes, thus urging the actuator rod 184 in the direction for closure of the air valve flaps 165 and 166.

The other ends of the spindle 167 and 168 extend through the end wall of the rectangular passage 117 which is nearer to the branch passage 118 and are coupled with the damper piston 192 of a damper 193 (see FIG. 3) by an arrangement similar to that described above with reference to FIG. 3 for coupling the spindles 167 and 168 to the actuator rod 184 of the air motor device 186. Thus movement of the air valve flaps 165 and 166 is damped by the damper 193.

The damper piston 192 slides with a dashpot 194 which is a deep drawn tubular vessel having a radial flange 195 at its upper end and a closed end wall at its other end. The dashpot 194 projects through an aperture 196 in a lower end wall of a cylindrical chamber 197 formed in the body 110. A coil spring 198 takes reaction from the lower end wall of the cylindrical chamber 197 and acts to hold the radial flange 195 in contact with the upper end wall of the cylindrical chamber 197. The damper piston rod 199 passes through an aperture 200 in the upper end wall of the cylindrical chamber 197. If the damping fluid in the dashpot 194 is excessively viscous, such as might be the case at low temperatures, the spring 198 may yield to permit movement of the dashpot 194 within the limits defined by the end walls of the cylindrical chamber 197, with movement of the damper piston 192. The likelihood of excessive damping and consequent incorrect metering of the air and fuel supplied by the carburetter, is minimised. Use of a deep drawn tubular vessel as the dashpot 194 is advantageous from the viewpoint of both manufacture and assembly.

FIG. 4 shows that that part of the lower casting 112 which forms the dividing wall 201 between the branch passages 118 and 119, defines a passage 202 which communicates at its downstream end with the induction passage downstream of the two throttle valves 163 and 164. The passage 202 communicates with the two passages 155A and 155B at its upstream end. An air supply passage 203 is arranged for connection to the carburetter air intake at its upstream end and is connected to the passage 202 between the ends thereof. The dividing wall 201 also defines a throttle by-pass passage 204 which places that part of one or both of the branch passages 118 and 119 upstream of the respective throttle valve 163, 164 in communication with the induction passage downstream of the two throttle valves 118 and 119.

Further passages (not shown) in the body 110 place the annular recesses defined by the annular grooves 142 and 148, which in turn communicate with the fuel metering orifices 131 and 135 via radial passages 143 and 149, in communication with the rectangular through passage 117 upstream of the air valve flaps 165 and 166. The further passages open through a restriction into one of the side walls of the through passage 117 directly upstream of the respective air valve flap spindle 167 or 168 and thus are subjected to a lower pressure when that flap is in its open position than when that flap is in its closed position so that air flow to the fuel metering orifices 131 and 135 is less when that flap is in its open position than it is when that flap is in its closed position.

When the carburetter is inoperative, the air valve flaps 165 and 166 are held engaged with the bar 152 by the action of the spring 191 fo the motor device 186. Thus the two profiled needles 139 and 145 are held by the linkage connecting them to the air valve flap 165 in the position in which their greatest area portions are located within the respective fuel metering orifice 131, 135 so that the effective area of that orifice 131, 135 is at its minimum.

When an automobile engine to which the carburetter is fitted is cranked for starting, a depression is established in the branch passages 118 and 119 between the throttle valves 163 and 164 and the air valve flaps 165 and 166. The magnitude of this depression established by cranking the engine, which also acts upon the diaphragm 187 of the air motor device 186 via the pipe 190, is insufficient to overcome the loading of the spring 191 so that the flaps 165 and 166 remained closed. However this depression does result in fuel being drawn from the float chamber 116 through the fuel metering orifices 131 and 135 wherein it is mixed with air drawn through said further passages from the rectangular through passage 117 upstream of the air valve flaps 165 and 166 to form an air fuel emulsion, the air/fuel emulsion emerging from the fuel metering orifices 131 and 135 being drawn through the passages 155A and 155B, the passages 154A and 154B and the fuel discharge nozzles 156 to 159 in a turbulent stream and emerging from the nozzles 156 to 159 for mixture with air which is drawn between the air valve flaps 165 and 166 and the bar 152. The arrangement of the projections on the profiled surfaces of the air valve flaps 165 and 166 and the cut away portions of the bar 152 concentrates the flow of air between the flaps 165 and 166 and the bar 152 into the regions of the mouth of the nozzles 156 to 159 and this maximises the speed of airflow flow past the mouths of the nozzles 156 to 159 whilst the air valve flaps 165 and 166 remain in their closed positions and when the mass flow of air between the flaps 165 and 166 and the bar 152 is low.

In addition to the air/fuel emulsion drawn into the mixing chambers through the fuel discharge nozzles 156 to 159 and to the air drawn past the air valve flaps 164 and 166 and the bar 152 air/fuel emulsion is drawn from the passages 155A and 155B to the induction passage downstream of the throttle valves 163 and 164 via the passage 202, this air/fuel emulsion being mixed in the passage 202 with additional air drawn from the carburetter air intake via the passage 203.

When the engine fires the depression acting on the downstream surfaces of the air valve flaps 165 and 166 increases and acts in opposition to the loading of the air motor spring 191 which urges the flaps 165 and 166 into engagement with the bar 152 so that the flaps 165 and 166 move in the opening direction. Furthermore the increased depression acts within the chamber 189 of the motor device 186 so as to provide assistance for movement of the air valve flaps 165 and 166 once they have separated from the bar 152, the assistance compensating for the reduction in the projected area of the air valve flaps 165 and 166 upon which the depression acts as the air valve is opening.

Once the air valve flaps 165 and 166 have separated from the bar 152 any tendency for the depression in either mixing chamber to increase results in opening movement of the air valve flaps 165 and 166 so that the area of each of the variable area throats is increased and the mass flow of air therethrough is increased, and also the mass of air/fuel emulsion drawn from the fuel discharge nozzle 156 to 159 is increased. A tendency for the depression in either mixing chamber to reduce has the converse effect. Thus the depression in the mixing chamber is maintained within acceptable upper and lower limits. As the air valve flaps 165 and 166 move towards the fully open position in which the flat downstream surface of each flap abuts the side wall of the rectangular through passage 117, the shielding effect provided by the flaps 165 and 166 which minimises the influence of mixing chamber depression upon the supply of air from the rectangular through passage 117 upstream of the flaps 165 and 166 to the fuel metering orifices 131 and 135 for mixture with fuel therein, diminishes so that the proportion of fuel in the air/fuel emulsion emerging from the fuel discharge nozzles 156 to 159 is less when the air valve is fully open than when it is closed.

It will be appreciated that the profiled needles 139 and 145 move with movement of the air valve flap 165, the arrangement being such that the effective area of the fuel metering orifices 131 and 135 increases as the air valve opens and decreases as the air valve closes.

The smooth convexly curved profiled upstream surface of the air valve flaps 165 and 166 results in the dimensions of each variable area throat being, for all practical purposes, at the minimum for each angular position of the respective air valve flap 165 and 166 so that the rate of flow of air through that throat is maximised. Secondly the location of each variable area throat is maintained substantially in the same location throughout movement of the respective air valve flap 165, 166 and that location being in line with the upstream edge of the fuel discharge slots 156 to 159 which yields the optimum relationship between air flow through the throat and discharge of the fuel/air emulsion through the discharge slots 156 to 159 for effective atomisation of the fuel and dispersion of the fuel through the mixing chambers.

When the engine is idling, the throttle valves 163 and 164 being closed, the air and fuel requirements of the engine are met by the flow of air/fuel emulsion from the mixing chambers to the induction passage downstream of the throttle valves via the throttle by-pass passage 204 and by the supply of air/fuel emulsion from the passages 155A and 155B and additional air from the carburetter air intake through the passage 203 via the passage 202.

Various modifications or refinements of the carburetter described above with reference to the accompanying drawings may be incorporated without departing from the scope of this invention. One such modification comprises the provision of a single fuel metering orifice, profiled needle and single passage in the body 110 for supplying air/fuel emulsion to a single fuel passage in the bar 152 which communicates with all the fuel discharge ports 156 to 159. The passage in the body 110 for supplying air from the rectangular through passage 117 upstream of the air valve flaps 165 and 166 to the fuel metering orifices 131 and 135 may be replaced by a passage in the middle casting 113 which communicates at one end with atmosphere outside the rectangular through passage 117, via a restricted orifice in the upper surface of the middle casting 113, conveniently near to the upper end of one of the tubular portions.

I claim:

1. An air valve carburetter of the pivoted flap air valve type comprising body, a branched through passage extending through the body, the branched through passage comprising a single upstream passage portion, a pair of downstream passage portions and a junction passage portion in communication with both the downstream passage portions; a bar that is supported by the body within a part of the through passage which is upstream of the two downstream passage portions whereby it extends substantially diametrically with respect to the two downstream passage portions; at least one throttle valve in the through passage downstream of the bar for controlling air flow through the two downstream passage portions; a pair of air valve flaps disposed within the through passage upstream of the downstream passage portions, said valve flaps being mounted pivotally within the body on opposite sides of the bar that extends between them, each of the pair of pivoted air valve flaps extending across the upstream ends of both the downstream passage portions cooperating with the bar to form a throat of variable area between itself and the bar and being disposed to pivot in response to a tendency for a depression established within either downstream passage portion between the bar and the throttle valve that controls air flow through that downstream passage portion to vary and thus to oppose a tendency for that depression to vary; and a fuel supply system operable to supply metered quantities of fuel from a respective fuel metering orifice to that part of the branched through passage between the bar and said at least one throttle valve through at least one fuel discharge nozzle in the bar.

2. An air valve carburetter of the pivoted flap air valve type according to claim 1, including a fuel discharge nozzle which opens into each variable area throat.

3. An air valve carburetter of the pivoted flap air valve type according to claim 2, wherein that part of the surface of each pivoted air valve flap which co-operates with the bar to define a variable area throat is curved convexly.

4. An air valve carburetter of the pivoted flap air valve type according to claim 3, wherein the upstream edge of each fuel discharge nozzle is positioned adjacent to that part of the bar which is in immediate proximity to the convexly curved surface part of the respective pivoted air valve flap when that air valve flap is in its closed position.

5. An air valve carburetter of the pivoted flap air valve type according to claim 1, wherein each air valve flap is hinged to the body at a point thereof opposite the bar, and the effective area of the fuel metering orifice from which metered quantities of fuel are supplied to that part of the branched through passage between the pivoted air valve flaps and each throttle valve downstream thereof is varied in accordance with variations in the area of the respective variable area throat by movement of a respective profiled needle which projects through that fuel metering orifice, a linkage connecting said needle to one of the respective pivoted flaps for movement therewith, said needle being guided for coaxial rectilinear movement relative to the fuel metering orifice, said linkage comprising a link which is hinged at one point outside the branched through passage to a part of the said one pivoted air valve flap which projects from the pivot mounting of that flap through an aperture in the wall of the branched through passage and which is hinged to the profiled needle at another point which is spaced from said one point.

6. A twin choke carburetter according to claim 5, wherein there are two fuel metering orifices each in communication with a respective one of the two variable area throats via a respective fuel discharge nozzle in the bar.

7. A twin choke carburetter according to claim 6, wherein the two profiled needles which project through the two fuel metering orifices are connected to a common one of the common pair of pivoted air valve flaps by a common linkage.

8. An air valve carburetter according to claim 5, wherein the end of the profiled needle remote from the profiled portion thereof passes through an aperture in one of the arms of the angled link and through a coil spring by which it is connected to said one arm, the arrangement being such that limited angular movement of the link relative to the profiled needle is permitted.

9. An air valve carburetter according to claim 8, wherein another arm of the angled link is pinned to that part of the associated flap which projects through the aperture in the wall of the through passage.

10. An air valve carburetter according to claim 8, wherein the angled link is U-shaped and the part of the associated flap which projects through the aperture in the wall of the through passage is bifurcated, the free end of each arm of the U-shaped angled link being pinned to a respective one of the branches of said bifurcated part and said aperture through which the profiled needle projects being defined within the base of the U-shaped angled link.

11. An air valve carburetter of the pivoted flap air valve type comprising a body, a branched through passage extending through the body, the branched through passage comprising a single upstream passage portion, a pair of downstream passage portions and a junction passage portion which places the single upstream passage portion in communication with both downstream passage portions; a bar which is supported by the body within a part of the through passage which is upstream of the two downstream passage portions whereby it extends diametrically with respect to the two downstream passage portions; at least one throttle valve in the through passage downstream of the bar for controlling air flow through the two downstream passage portions; a pair of air valve flaps disposed within the through passage upstream of the downstream passage portions, said valve flaps being mounted pivotally within the body on opposite sides of the bar that extends between them, each of the pair of pivoted air valve flaps extending across the upstream ends of both the downstream passage portions having a surface which is curved convexly and which co-operates with the bar to form a throat of variable area between itself and the bar, and being disposed to pivot in response to a tendency for a depression established within either downstream passage portion between the bar and the throttle valve that controls air flow through that downstream passage portion to vary and thus to oppose a tendency for that depression to vary; and a fuel supply system comprising at least one fuel discharge nozzle in each side of the bar for supplying metered volumes of fuel to the variable area throat that is formed between the respective side of the bar and the adjacent air valve flaps, each fuel discharge nozzle being disposed with its upstream edge positioned adjacent to the convexly curved surface of the adjacent air valve flap when the latter is in its closed position.

12. An air valve carburetter of the pivoted flap air valve type according to claim 11, wherein the bar tapers in an upstream direction to define an apex and that part of the apex directly upstream of each fuel discharge nozzle tapers to an arcuate leading edge and the remaining of the bar projects in an upstream direction beyond that arcuate leading edge to another arcuate leading edge which has a larger radius of curvature than has the arcuate leading edge directly upstream of the fuel discharge nozzle.

13. An air valve carburetter of the pivoted flap air valve type according to claim 11, wherein during movement of each pivoted air valve flap the locus of that part of each pivoted flap which is nearest the bar is substantially in a plane which is normal to that part of the bar which is in immediate proximity to the convexly-curved surface part of that pivoted air valve flap when that air valve flap is in its closed position.

14. An air valve carburetter of the pivoted flap air valve type according to claim 13, wherein each pivoted air valve flap is hinged to the body at its end remote from the bar, the profiled surface of each flap being the surface of that flap which faces upstream when that flap is in the closed position.

15. An air valve carburetter of the pivoted flap air valve type according to claim 14, including air supply means for feeding air to each fuel metering orifice for mixture with fuel therein to form as air/fuel emulsion, said air supply means having a mouth which opens into the through passage within which the respective pivoted air valve flap is hinged upstream of that air valve flap, whereby the pressure at the mouth of the air supply means is lower when that air valve flap is in its open position than it is when that air valve flap is in its closed position so that the air flow to the fuel metering orifice is less when that flap is in its open position that it is when that flap is in its closed position.

16. The air valve carburetter of the pivoted flap air valve type of claim 11 comprising a depression-responsive fluid pressure motor device having a movable wall and a space on one side of the movable wall, means linking each air valve flap to the said movable wall, resilient means urging the said air valve flap towards its closed position, conduit means in said body connecting the through passage with said space, said conduit means being adapted to transmit a substantial part of a depression established within the through passage by air flow therethrough once the pivoted air valve flap has opened a predetermined amount whereby the transmitted depression will act upon the movable wall to oppose the resilient means.

17. An air valve carburetter of the pivoted flap air valve type according to claim 16, wherein the mouth of the conduit means is defined within the bar upstream of the fuel discharge nozzle in the bar.

18. An air valve carburetter of the pivoted flap air valve type according to claim 17, wherein the respective air valve flap is provided with projections which project from its convexly curved surface towards the bar on each side of the mouth of the conduit means and define a gap between said valve flap and said mouth of the conduit when the respective air valve is in its closed position.

19. An air valve carburetter of the pivoted flap air valve type according to claim 11, wherein each fuel discharge nozzle is directed laterally with respect to the through passage so that the fuel supply to the respective variable area throat therethrough is directed substantially normal to the path of air flow through that throat.

20. An air valve carburetter of the pivoted flap air valve type according to claim 19, wherein each fuel discharge nozzle comprises a divergent slot port, the inlet of the divergent slot port, which is nearer to the fuel metering orifice, having a smaller cross-sectional area than the outlet of the divergent slot port which opens into the variable area throat.

21. An air valve carburetter of the pivoted flap air valve type as claimed in claim 20, wherein the convexly-curved profiled surface of each pivoted air valve flap is provided with projections which project from the convexly-curved surface towards the bar, each projection being opposite a respective end of the associated fuel discharge nozzle when the respective pivoted air valve flap is in its closed position, there being a gap defined between that pivoted air valve flap, the bar and the respective juxtaposed pair of projections in the region of the mouth of the associated fuel discharge nozzle so that air can flow past the mouth of the associated fuel discharge nozzle when that air valve flap is in its closed position.

22. An air valve carburetter according to claim 10, wherein the projections engage longitudinally extending portions of the bar on each side of the mouth of the associated fuel discharge nozzle so that air flow between that flap and the bar is concentrated in the region of the mouth of the associated fuel discharge nozzle when that air valve flap is in its closed position.

23. An air valve carburetter of the pivotted flap air valve type comprising a body with a through passage formed in it, a throttle valve for controlling air flow through the through passage, an air valve flap mounted pivotally within the body upstream of the throttle valve, part of the air valve flap co-operating with adjacent structure to define a throat of variable area, the air valve flap being hinged to the body at a point which is opposite said part of that air valve flap, and being disposed to pivot in response to a tendency for a depression established within the induction passage downstream of the air valve flap to vary and thus to oppose any tendency for the said depression to vary and so that said part of that flap is drawn towards the respective throttle valve by such a depression when the carburetter is fitted to an engine for use, and a fuel supply system which includes a fuel metering orifice and a fuel discharge nozzle and which is operable to supply metered quantities of fuel through the fuel discharge nozzle to that part of the through passage between the pivoted flap and the throttle valve, a profiled needle which projects through the fuel metering orifice, a linkage which connects the needle to the pivoted flap such that the needle moves relative to the fuel metering orifice with movement of the pivoted flap so that the effective area of the fuel metering orifice is varied in accordance with variations in the area of the variable area throat, and guide means which guide the needle for coaxial rectilinear movement relative to the fuel metering orifice, wherein an aperture is formed in the wall of the through passage adjacent to the pivot mounting of the flap, another part of the flap projects from the pivot mounting of the flap through the aperture and is bifurcated outside the through passage, and the linkage comprises a U-shaped angled link, the free end of each of the U-shaped angled link being pinned to a respective one of the branches of said bifurcated flap part and a point on the angled link which is spaced from the free ends of the arms of the angled link is hinged to the profiled needle by a flexible hinge.

24. An air valve carburetter of the pivoted flap air valve type according to claim 23, wherein the end of the profiled needle remote from the profiled portion thereof passes through an aperture which is formed in the angled link at said point and through a coil spring by which it is connected to said angled link at said point, the arrangement being such that limited angular movement of the link relative to the profiled needle is permitted.

* * * * *